US007544074B2

(12) United States Patent
Buck et al.

(10) Patent No.: US 7,544,074 B2
(45) Date of Patent: Jun. 9, 2009

(54) ELECTRICAL PLUG CONNECTOR ASSEMBLY HAVING A DEFINED PLUG-IN SEQUENCE

(75) Inventors: Carsten Buck, Heppenhelm (DE); Rolf Jetter, Darmstadt (DE); Alexander Stokowski, Oetisheim (DE)

(73) Assignee: Tyco Electroncis AMP GmbH, Bensheim (DE)

( * ) Notice: Subject to any disclaimer, the term of this patent is extended or adjusted under 35 U.S.C. 154(b) by 21 days.

(21) Appl. No.: 11/853,270

(22) Filed: Sep. 11, 2007

(65) Prior Publication Data

US 2008/0076290 A1 Mar. 27, 2008

(30) Foreign Application Priority Data

Sep. 21, 2006 (DE) ..... 10 2006 044 655

(51) Int. Cl.
*H01R 13/44* (2006.01)

(52) U.S. Cl. ..... 439/144

(58) Field of Classification Search ..... 439/144, 439/127, 159, 160, 372, 299
See application file for complete search history.

(56) References Cited

U.S. PATENT DOCUMENTS 4,867,699 A 9/1989 Oda
5,017,147 A 5/1991 Sugiyama
6,814,606 B2 * 11/2004 Kobayashi ..... 439/372

* cited by examiner

*Primary Examiner*—Chandrika Prasad
(74) *Attorney, Agent, or Firm*—Barley Snyder LLC

(57) ABSTRACT

The present invention relates to an electrical plug connector assembly comprising a first connector (2), a second connector (29), a third connector (3) and a fourth connector (33). The first and the second connector (2, 29) form a first pair of connectors. The third and the fourth connector (3, 33) form a second pair of connectors. The first connector (2) and the third connector (3) are arranged on a housing (1). A locking element (7) is provided on the housing (1). The locking element (7) is configured as a slide and is displaceably mounted on the housing (1). In a starting position, the locking element (7) blocks at least partially an insertion opening (15) on the housing (1) for inserting the fourth connector (33) into the third connector (3). The second connector (29) has a guide bolt (30). The locking element (7) has guide surface (37, 52). On connection of the second connector (29) to the first connector (2), the guide bolt (30) acts on the guide surface (37) to urge the locking element (7) into a release position. In the release position, the locking element (7) clears the insertion opening (15) for connecting the fourth connector (33) to the third connector (3).

12 Claims, 7 Drawing Sheets

ELECTRICAL PLUG CONNECTOR ASSEMBLY HAVING A DEFINED PLUG-IN SEQUENCE

CROSS-REFERENCE TO RELATED APPLICATIONS

This application claims the benefit of the filing date under 35 U.S.C. § 119 (a)-(d) of German Patent Application No. DE 10 2006 044 655.0; filed Sep. 21, 2006.

FIELD OF THE INVENTION

The invention relates to an electrical plug connector assembly having a defined plug-in sequence.

BACKGROUND

For various applications, it may desirable to define the plug-in sequence for two pairs of plug connectors. For example, for safety reasons a second pair of plug connectors may not to be assembled until a first pair of plug connectors has been connected. This type of arrangement is desirable, for example, in the case of airbags.

U.S. Pat. No. 4,867,699 discloses a generic electric plug connector assembly in which a first and a third connector are arranged in a housing. A second connector is associated with the first connector and a fourth connector is associated with the third connector. A locking projection on the housing prevents the fourth connector from being attached to the third connector before the second connector has been connected to the first connector. The second connector has a projection comprising a ramp which is moved before the locking projection on insertion of the second connector into the first connector. The ramp allows a locking element of the fourth connector to be raised and moved beyond the locking projection on attachment of the fourth connector to the third connector to define a plug-in sequence of the two pairs of connectors.

SUMMARY

An object of the invention, among others, is to provide a more robust plug connector assembly having a defined plug-in sequence for two pairs of plug connectors.

An electrical plug connector assembly according to the invention has a first connector, a second connector having a guide bolt projecting therefrom, a third connector and a fourth connector. A housing houses the first and third connectors and has an insertion opening for receiving a portion of the fourth connector. A locking element is located in the housing for preventing the third connector from connecting to the fourth connector. The locking element is displaceably mounted in the housing to at least partially block the insertion opening, when in a starting position, thus preventing insertion of the fourth connector. The locking element has a guide surface for receiving the guide bolt such that on connection of the second connector to the first connector, the guide bolt acts on the guide surface to urge the locking element into a release position, wherein the locking element clears the insertion opening for receiving the fourth connector allowing its connection to the third connector.

BRIEF DESCRIPTION OF THE DRAWINGS

The invention will now be described with reference to the figures, in which.

DETAILED DESCRIPTION OF THE EMBODIMENTS

Figure 1:
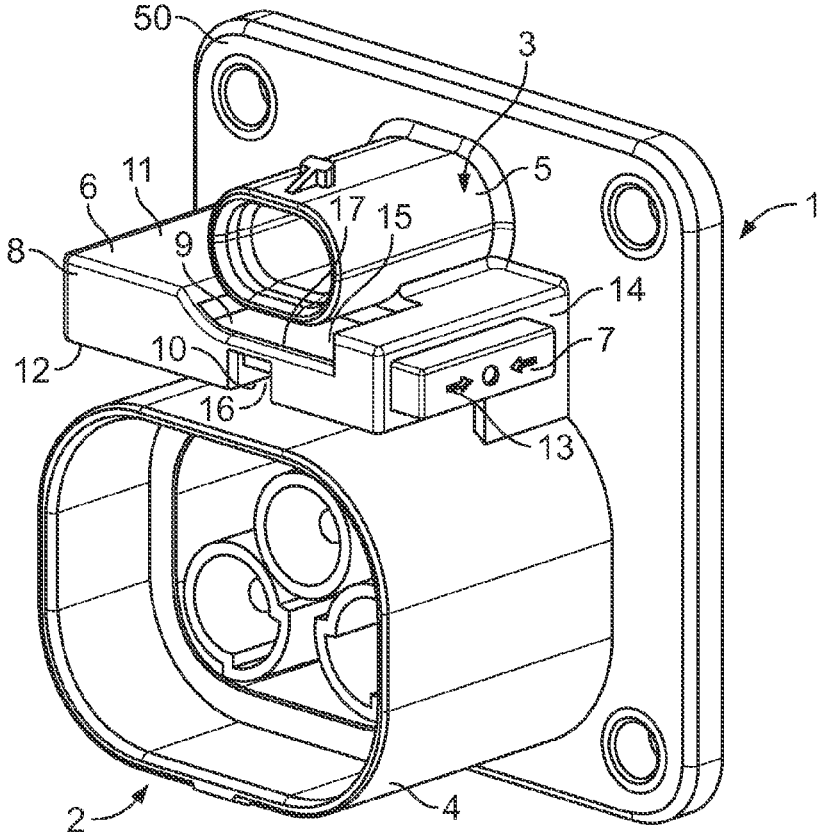
FIG. 1 is a perspective view of a housing comprising a first and a third connector.

FIG. 1 shows a housing 1 having a first connector 2 and a third connector 3. Electrical contacts (not shown) are provided in the first connector 2 and in the third connector 3. The housing 1 has substantially a square plate 50 from which there extend backwards a first pin collar 4 for the first connector 2 and a second pin collar 5 for the third connector 3. Provided between the first and the second pin collar 4, 5 is a guide housing 6 surrounding a guide chamber. A locking element 7 is arranged in the guide chamber. The locking element 7 is mounted in the guide housing 6 so as to be displaceable substantially perpendicularly to the direction of insertion of the first and the second connector 2, 3. The guide housing 6 has a back 8 comprising a first recess 9 and a second recess 10. The first recess 9 protrudes from a top 11 of the guide housing 6 and extends toward the back 8. The first recess 9 is arranged below the second pin collar 5. The second recess 10 protrudes from a bottom 12 of the guide housing 6 and extends toward the back 8. On the back 8, the second recess 10 is substantially rectangular in contour. The top 11 of the guide housing 6 is opened over the same width as the back 8 by the first recess 9 down to a defined depth below the second pin collar 5. Correspondingly, the bottom 12 of the guide housing 6 is opened along a direction of insertion into the first connector 2 down to a defined depth. An actuating surface 13 of the locking element 7 protrudes beyond a lateral surface 14 of the guide housing 6. The locking element 7 is in the release position in which the locking element 7 does not occupy the first recess 9 on the back 8, which recess is an insertion opening 15.

The guide housing 6 may also have a different shape, the purpose of the guide housing 6 being that of guiding the locking element 7 in a defined direction of movement. A further purpose of the guide housing 6 is to provide first and second insertion openings 15, 16 for inserting a portion of the fourth connector 33 and a portion of the second connector 29. The first insertion opening 15 and the second insertion opening 16 are formed on the back 8 of the guide housing 6 and arranged one above the other. In addition, in the illustrated embodiment, the first and the second insertion opening 15, 16 are arranged between the first and the third connector 2, 3. In the illustrated embodiment, the first and the second insertion opening 15, 16 are set apart from each other by a wall web 17. The housing 1 is made of an insulating material, for example a plastics material.

Figure 2:
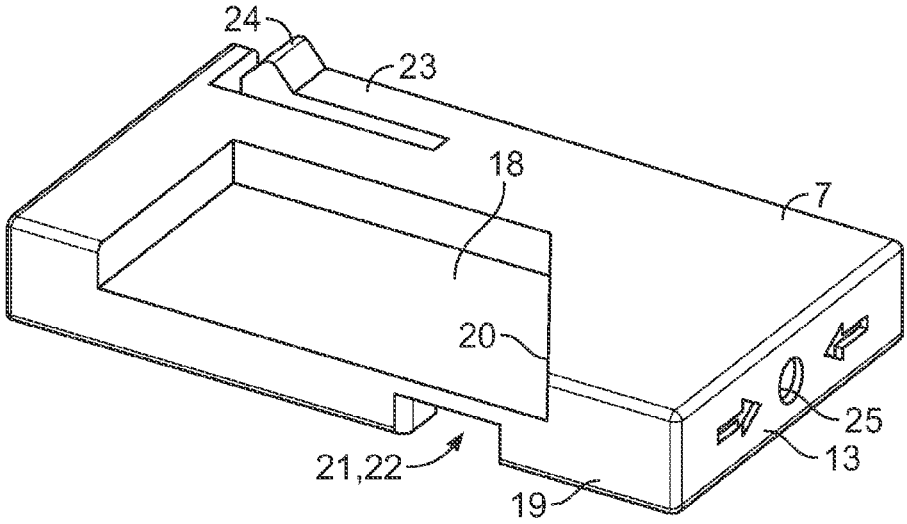
FIG. 2 is a perspective view of the top of an engagement slide.

FIG. 2 shows an embodiment of the locking element 7. The locking element 7 has a substantially planar shape comprising a third recess 18. The third recess 18 proceeds from a top and extends into the locking element 7 down to a defined depth. In addition, the third recess 18 extends up to a longitudinal side 19 of the locking element 7. The third recess 18 is delimited by a base surface and three lateral surfaces. A first lateral surface 20 extends from the longitudinal side 19 at an angle of greater than 90° to the longitudinal side 19. A fourth recess 21 is formed in the locking element 7 below the third recess 18, a fourth insertion opening 22 in the fourth recess 21 adjoining the longitudinal side 19 of the locking element 7.

Opposite the longitudinal side 19, the locking element 7 has on a top a catch element 23 on the other longitudinal side. The catch element 23 is in the form of a resilient arm. A catch projection 24 is formed at a free end and protrudes beyond the top of the locking element 7. An actuating recess 25 for receiving a tool is located on a an actuating surface 13 of the locking element 7.

Figure 3:
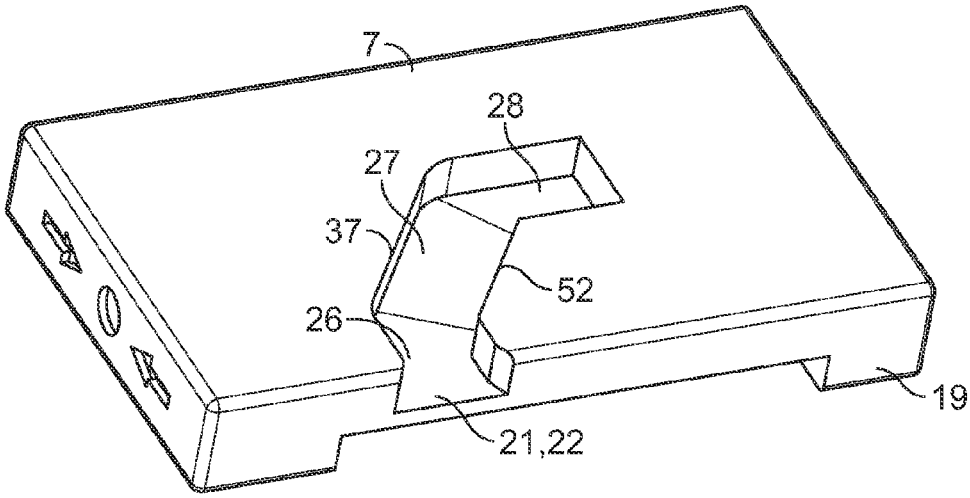
FIG. 3 is a perspective view of the bottom of the engagement slide.

FIG. 3 shows the bottom of the locking element 7. Starting from the fourth insertion opening 22, the fourth recess 21 extends in a first portion 26 substantially perpendicularly to the longitudinal side 19. After a defined distance, the first portion 26 bends down into a second portion 27. The second portion 27 is delimited by two guide surfaces 37, 52 which are arranged parallel to each other and at an angle of less than 90° to the longitudinal side 19. After a defined second distance, the second portion 27 merges with a third portion 28. The third portion 28 is delimited by two parallel lateral surfaces arranged substantially parallel to the longitudinal side 19. The longitudinal side 19 defines the axis of movement in which the locking element 7 is movable in the guide housing 6.

Figure 4:
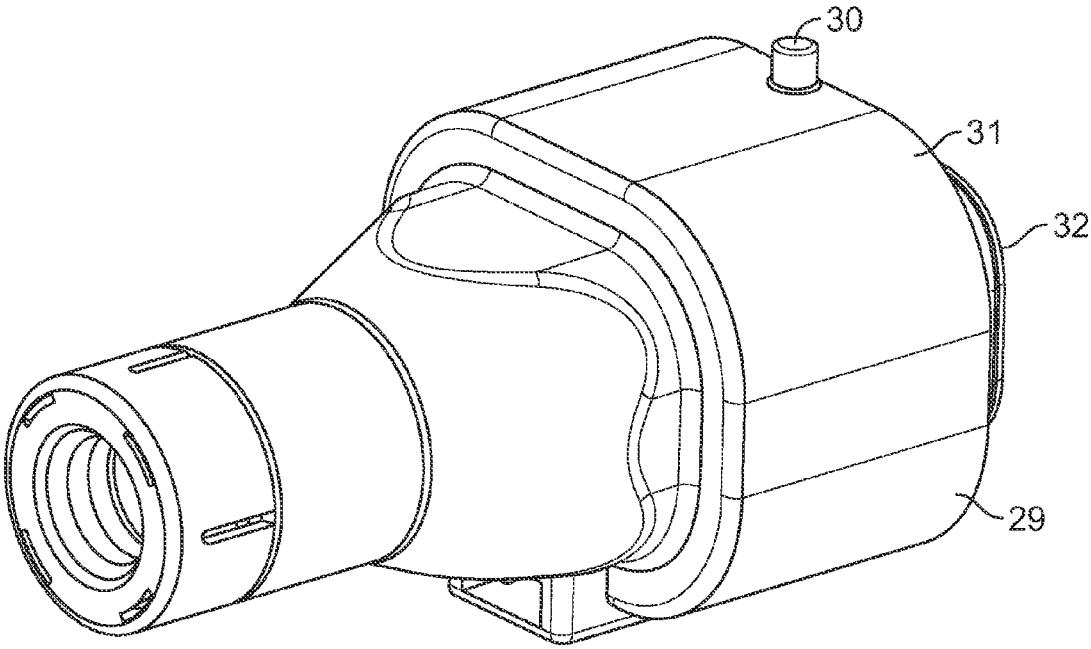
FIG. 4 is a perspective view of a second connector.

FIG. 4 shows a second connector 29 comprising a connector housing 31. a guide bolt 30 protrudes from the outer contour of the connector housing 31. The second connector 29 has a front-side insertion contour 32 which is adapted to the insertion contour of the first connector 2 and guides the second connector 29 when inserted into the first connector 2. For example, the second connector 29 has a sleeve-like third pin collar which, on attachment, surrounds the first pin collar 4 of the first connector 2 and is guided by the first pin collar 4.

Figure 5:
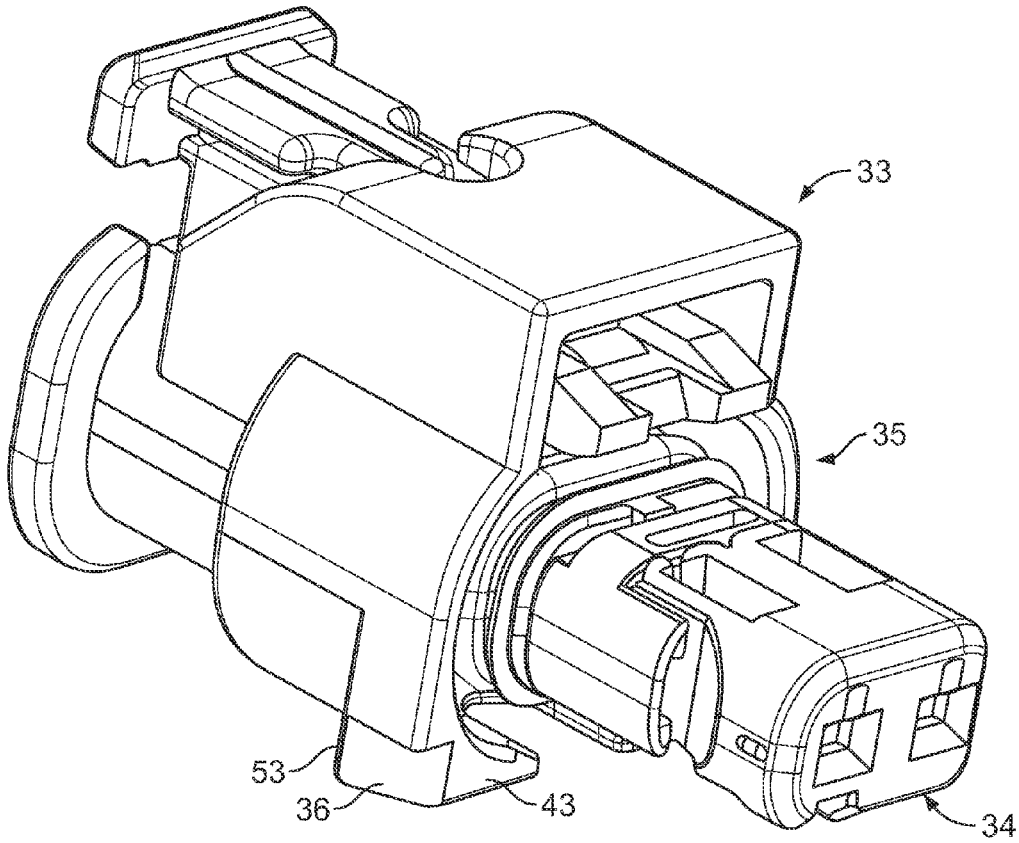
FIG. 5 is a perspective view of a fourth connector.

FIG. 5 shows a fourth connector 33. The fourth connector 33 has a fourth insertion contour 34 configured for insertion into the corresponding insertion contour of the third connector 3. The fourth insertion contour 34 has, for example, a pin collar which, on attachment to the third connector 3, is guided by the second pin collar 5. The fourth connector 33 has a fourth connector housing 35 which has, in a lower corner region, a deflection contour 36 in the form of an inclined lateral surface. Starting from a front side 43, the inclined lateral surface is guided obliquely backward from an inner region and outward to a lateral region 53 of the connector housing 35.

Figure 6:
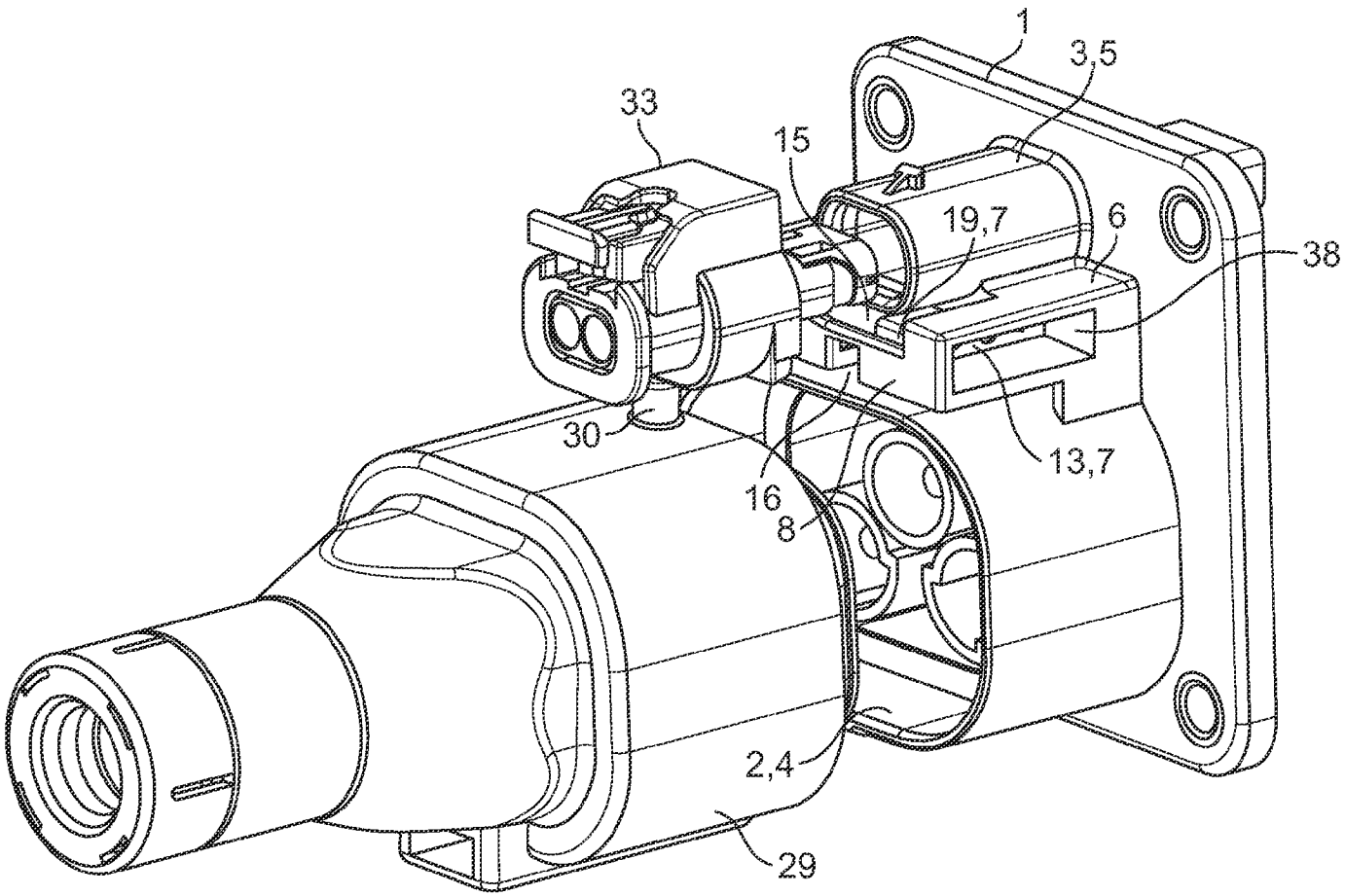
FIG. 6 is a perspective view of the connection assembly comprising the housing with the first and third connector and with the second and fourth connector prior to insertion.

FIG. 6 is a partial view of the housing 1 with the locking element 7 being in the starting position. In the starting position, a portion of the longitudinal side 19 of the locking element 7 blocks the first insertion opening 15. The fourth insertion opening 34 of the fourth connector 33 is formed on the insertion side in such a way that the entire width of the first insertion opening 15 is required for inserting the fourth connector 33 into the third connector 3. In the position illustrated in FIG. 6, the locking element 7 blocks the first insertion opening 15, so the fourth connector 33 cannot be inserted into the third connector 3.

Furthermore, the second connector 29 is oriented toward the first connector 2. The guide bolt 30 of the second connector 29 is in this case oriented toward the second insertion opening 16 in the guide housing 6. In the starting position, the locking element 7 is arranged in such a way that the fourth insertion opening 22 in the fourth recess 21 overlaps the second insertion opening 16, thus allowing the second connector 29 to be inserted into the fourth recess 21 using the guide bolt 30. In addition, the insertion contour of the second connector 29 may be completely inserted into the insertion contour of the first connector 2 and an electrical contact established between the electrical contacts of the first and the second connector 2, 29. On insertion of the second connector 29 into the first connector 2, the guide bolt 30 slides firstly into the first portion 26 of the fourth recess 21. If the second connector 29 is inserted completely into the first connector 2, the guide bolt 30 is pressed against the second guide surface 37, the locking element 7 being moved laterally toward a locking element opening 38 in the guide housing 6. The lateral movement of the locking element 7 completely releases the first insertion opening 15.

Figure 7:
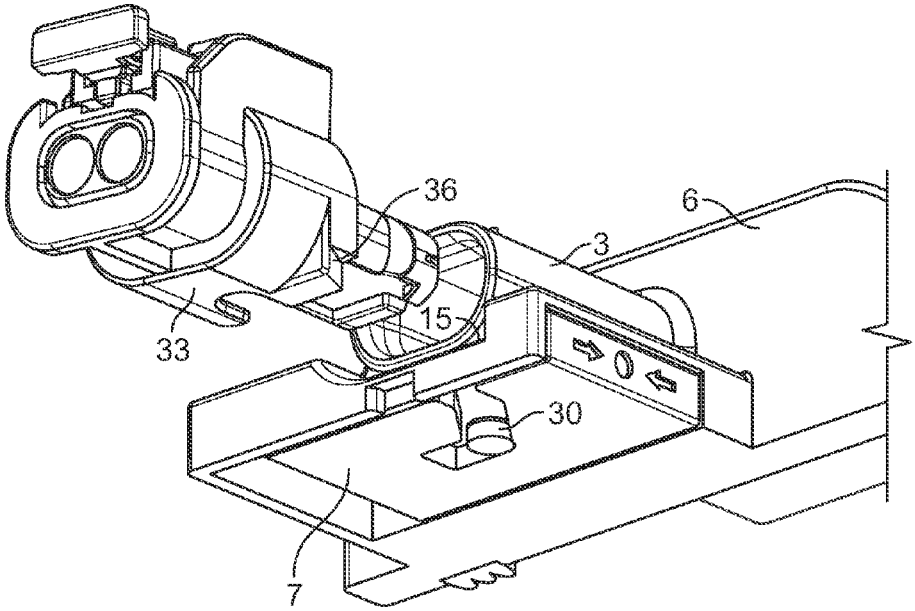
FIG. 7 is a partial perspective view of the housing comprising an inserted second connector and a fourth connector prior to insertion.

FIG. 7 shows a partial detail of the guide housing 6, the second connector 29 having been completely inserted, with only the guide bolt 30 of the second connector 29 being shown. In this position, the locking element 7 is displaced toward the right relative to the starting position, thus clearing the first insertion opening 15.

Figure 8:
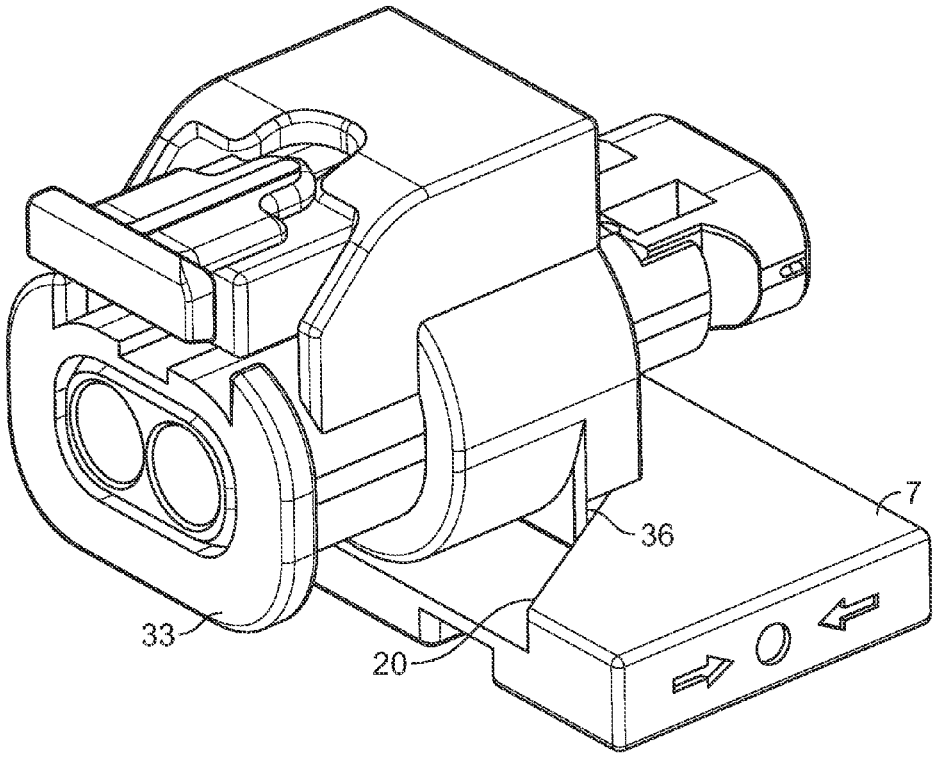
FIG. 8 is a partial perspective view of the housing, the second and fourth connectors having been inserted.
Figure 9:
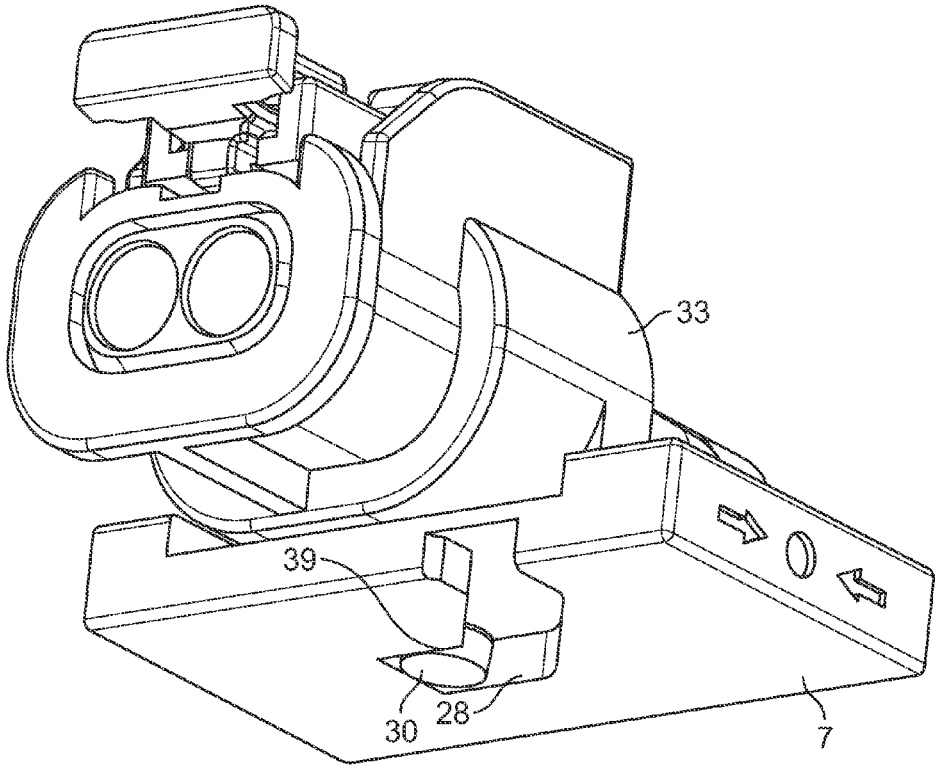
FIG. 9 is a partial perspective of the housing, the second and fourth connectors having been inserted, looking onto the engagement slide from below.

The fourth connector 33 can then be inserted into the third connector 3. On insertion of the fourth connector 33 into the third connector 3, the deflection contour 36 acts on the first lateral surface 20 of the third recess 18, as shown in FIG. 8. FIG. 8 shows the situation on insertion of the fourth connector 33 into the third connector 3, where only the fourth connector 33 and the locking element 7 are shown for the sake of clarity. On insertion of the fourth connector 33 into the third connector 3, the locking element 7 is moved from the release position laterally further toward the right into an engagement position. On insertion of the fourth connector 33, the deflection contour 36 acts on the first lateral surface 20 of the locking element 7 and urges the locking element 7 laterally toward the right. Once the fourth connector 33 has been completely inserted into the third connector 3, the locking element 7 is moved sufficiently far toward the right for the guide bolt 30 to be positioned in the third portion 28. This is shown in a partial illustration in FIG. 9. Of the second connector 29, only the guide bolt 30 is shown here for the sake of clarity. In the engagement position, the second connector 29 cannot be detached from the first connector 2, as detachment is prevented by a locking surface 39 of the locking element 7 that rests against the guide bolt 30. When fully attached, the fourth connector 33 catches on the housing 1, for example via a catch projection.

Figure 10:
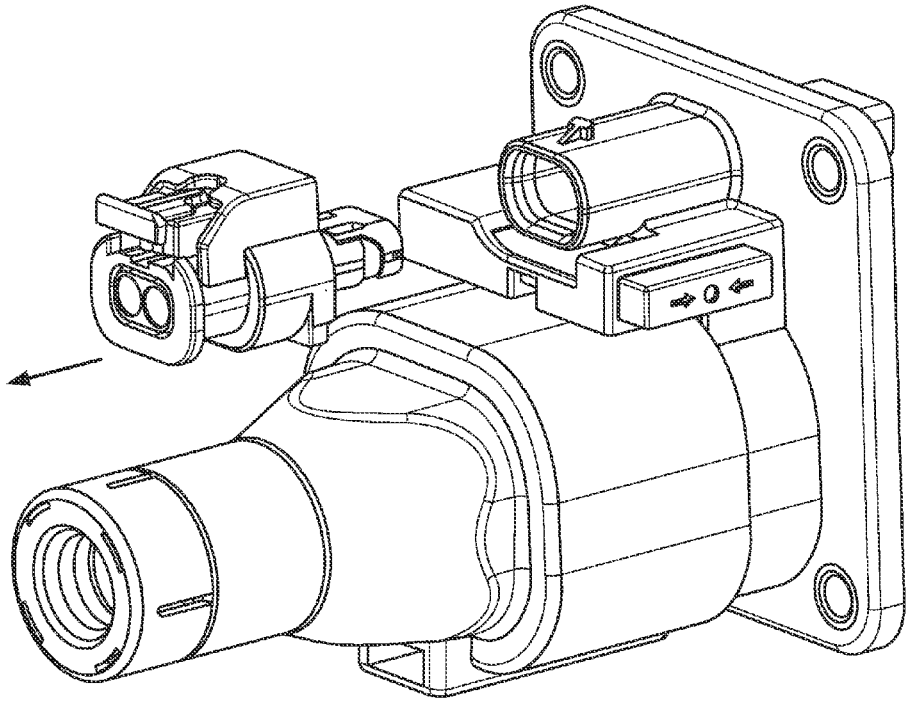
FIG. 10 is a perspective view showing the plug connector assembly with the second connector inserted and the fourth connector detached.

If the fourth connector 33, as illustrated in FIG. 10, is detached from the third connector 3, the locking element 7 remains in the engagement position. The second connector 29 is therefore not yet able to be detached from the first connector 2.

Figure 11:
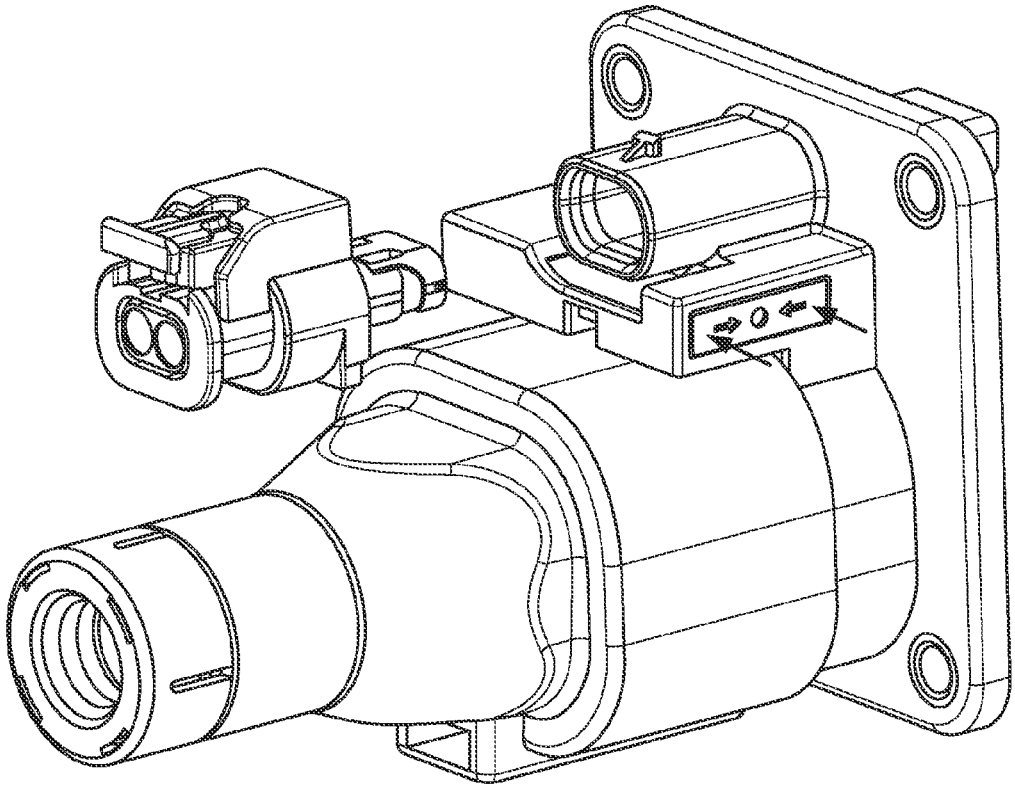
FIG. 11 is a perspective view showing the plug connector assembly with the second connector and engagement slide inserted.

Only once the locking element 7 has been actuated, for example, once the locking element 7 has been pressed laterally into the guide housing 6 as indicated schematically by arrows in FIG. 11, is the locking element 7 moved in such a way that the guide bolt 30 leaves the third portion 28 and is located in the second portion 27. Only then is it possible to detach the second connector 29. On detachment of the second connector 29, the guide bolt 30 slides on the first guide surface 52 of the second portion 27 of the locking element 7 and thus moves the locking element 7 into the starting position in which the first insertion opening 15 is, again, at least partially sealed by the locking element 7. It is therefore not possible to insert the fourth connector 33 into the third connector 3.

The first pair of connectors 2, 29 can be used for conducting a supply voltage and the second pair of connectors 3, 33 can be used for conducting a control signal. The control signal can, for example, inform a control circuit that the first pair of connectors 2, 29 is fully contacted.

Figure 12:
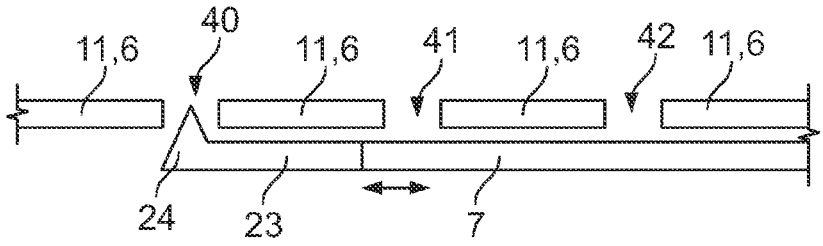
FIG. 12 is a schematic view of catch positions of the engagement slide.

FIG. 12 shows a schematic cross-section through the locking element 7 and the top 11 of the guide housing 6. The catch 23, 24 is engaged in a first catch recess 40 in the top 11, the locking element 7 being in the starting position. If the locking element 7 is moved into the release position, the first catch 23, 24 leaves the first catch recess 40 and catches in a second catch recess 41. If the locking element 7 is moved by the fourth connector 33 into the engagement position, the first catch leaves the second catch recess 41 and catches in a third catch recess 42.

The electrical plug connector assembly has an advantage, among others, that the locking element is robust in its configuration and reliably allows connection of the second pair of connectors only once the first pair of connectors has been connected.

It will be understood and appreciated by those skilled in the art that although the invention has been described here using illustrative embodiments, the scope of the invention is broader than the disclosed embodiments and is limited only by the claims.

What is claimed is:

1. An electrical plug connector assembly comprising:

a first connector;

a second connector having a guide bolt projecting therefrom;

a third connector;

a fourth connector;

a housing having a substantially square plate from which there extend backwards a first pin collar for the first connector and a second pin collar for the third connector;

a guide housing between the first and second pin collar, the guide housing has an insertion opening for receiving a portion of the fourth connector; and a locking element mounted in the guide housing so as to be displaceable substantially perpendicularly to the direction of insertion of the first and the second connector, the locking element preventing the third connector from connecting to the fourth connector, the locking element being displaceably mounted in the housing to at least partially block the insertion opening, when in a starting position, thus preventing insertion of the fourth connector, the locking element having a guide surface, for receiving the guide bolt such that on connection of the second connector to the first connector the guide bolt acts on the guide surface to urge the locking element into a release position, wherein the locking element clears the insertion opening for receiving the fourth connector allowing its connection to the third connector.

2. The electrical plug connector assembly according to claim 1, wherein on detachment of the second connector from the first connector the guide bolt acts on the guide surface to move the locking element back into the starting position.

3. The electrical plug connector assembly according to claim 2, wherein the locking element has a first lateral surface, for receiving a deflection contour of the fourth connector such that, on connection of the fourth connector to the third connector the deflection contour acts on the first lateral surface to urge the locking element into an engagement position, engaging the second connector with the first connector.

4. The electrical plug connector assembly according to claim 3, wherein on detachment of the fourth connector from the third connector the locking element remains in the engagement position and the locking element can be moved manually or using a tool into the starting position for releasing the second connector.

5. The electrical plug connector assembly according to claim 4, wherein in the engagement position, an actuating surface of the locking element protrudes beyond a surface of the housing and is engagable for urging the locking element into the starting position.

6. The electrical plug connector assembly according to claim 1, wherein the guide bolt is a cam.

7. The electrical plug connector assembly according to claim further comprising a guide chamber in the housing, the guide chamber being rectangular in cross-section and being configured to receive the locking element.

8. The electrical plug connector assembly according to claim 7 wherein the locking element is substantially planar and rectangular in cross-section.

9. The electrical plug connector assembly according to claim 8 wherein the locking element has as a third recess having a first lateral surface.

10. The electrical plug connector assembly according to claim 9 wherein the locking element has as a fourth recess on a second side opposing the first side, the fourth recess having a first and second guide surfaces.

11. The electrical plug connector assembly according to claim 7 wherein the locking element is mounted in the guide chamber on the housing between the first and the third connector.

12. The electrical plug connector assembly according to claim 7 , wherein the locking element has a catch, being engageable with at least one catch recess in the guide chamber.

* * * * *

UNITED STATES PATENT AND TRADEMARK OFFICE

CERTIFICATE OF CORRECTION

PATENT NO. : 7,544,074 B2
APPLICATION NO. : 11/853270
DATED : June 9, 2009
INVENTOR(S) : Carsten Buck et al.

It is certified that error appears in the above-identified patent and that said Letters Patent is hereby corrected as shown below:

In column 6, line 33, "claim further comprising a guide" should read -- claim 11 further comprising a guide --.

Signed and Sealed this

Third Day of November, 2009

David J. Kappos

David J. Kappos
*Director of the United States Patent and Trademark Office*